United States Patent [19]

Geraci

[11] 4,065,130

[45] Dec. 27, 1977

[54] BOARD GAME WITH TIME INDICATOR MEANS

[76] Inventor: Vincent M. Geraci, 1550 N. Lake Shore Drive, Apt. 3G, Chicago, Ill. 60610

[21] Appl. No.: 660,050

[22] Filed: Feb. 23, 1976

[51] Int. Cl.[2] ..... A63F 3/00

[52] U.S. Cl. ..... 273/130 AB; 273/136 A

[58] Field of Search ..... 273/130 AB, 130 B, 131 D, 273/135 B, 136 A, 136 C, 136 E, 157 R, 131 A, 134 A, 135 A, 137 A, 1 E

[56] References Cited

U.S. PATENT DOCUMENTS

| | | | |
|---|---|---|---|
| 1,033,422 | 7/1912 | Langley et al. | 273/136 C |
| 1,439,359 | 12/1922 | Estes | 273/157 R |
| 1,714,792 | 5/1929 | Kurihara | 273/130 B |
| 2,592,897 | 4/1952 | Heinoo | 273/136 C |
| 3,145,993 | 8/1964 | Archer | 273/130 B |
| 3,603,591 | 9/1971 | Shoptaugh | 273/136 C |
| 3,825,266 | 7/1974 | Bissell | 273/130 AB |

FOREIGN PATENT DOCUMENTS

| | | | |
|---|---|---|---|
| 1,149,933 | 7/1957 | France | 273/136 A |
| 868,040 | 9/1941 | France | 273/130 B |
| 1,114,268 | 5/1968 | United Kingdom | 273/130 B |
| 2,699 | 2/1890 | United Kingdom | 273/130 B |

*Primary Examiner*—William H. Grieb
*Assistant Examiner*—Harry G. Strappello
*Attorney, Agent, or Firm*—Alter and Weiss

[57] ABSTRACT

Board structure and apparatus is provided for a game in which the placement on the board of any playing piece must be at a site contiguous to the site of the most recently previously played piece. Plays must be made within a time limit which may be adjusted to the levels of skill of the game participants. Provision is made to positively index playing pieces at the sites selected for play. In one preferred version, each site has mounted thereunder an illuminating lamp and circuitry intended to illuminate such lamp for the specified time limit when a playing piece is played at that site. Translucent board structure and playing pieces may be provided, such that illumination of the site serves to illuminate the playing piece as well in such a version. Thus, play of a piece at any site automatically illuminates that site for the chosen time limit, and any subsequent play must be made before the illumination at that site is extinguished.

5 Claims, 5 Drawing Figures

BOARD GAME WITH TIME INDICATOR MEANS

This invention relates to board games, and more particularly, to a board game with playing sites arranged in fixed geometric configuration, such sites having provision for positively indexing game pieces played at said sites, such play to be carried out within a specified time limit of the most recent previous play.

Games in which exercise and use of logic and strategy are employed and required have long been popular as home entertainment, as well as in a more competitive tournament setting for more skilled players. Games such as chess and backgammon, however, feature game pieces whose movements are subject to complex and difficult rules, making mastery of the strategies inherent in such games a long and arduous undertaking. Games with simpler rules, even though easier for the novice to master, generally present less of a competitive challenge. The need therefore exists for a game, the basic rules and structure for which are simply learned yet for which the logic and strategies involved during play are entertaining as well as challenging.

Accordingly, this invention has the following objects:

To provide apparatus and structure for a game easily learned and playable both in the home and in a tournament setting;

To provide such apparatus and structure in forms which positively index playing pieces on a playing surface;

To provide structure for measuring off variable time limits for successive moves by players;

To provide such apparatus in specifically defined, geometric configurations; and To provide such apparatus and structure in portable as well as non-portable versions.

These and other objects will become more apparent on consideration of the accompanying drawings in which.

Consistent with the foregoing objectives, the apparatus and structure for a game of logic and strategy are provided wherein playing pieces 10 are playable and positively indexed at playing piece sites 12, with each subsequent play limited to one playing site immediately contiguous to the most recently previously played piece. Each play must be made within a variably set time limit, and means are provided to indicate the beginning and end of said limit, said means being actuated automatically by the playing of a piece at any playing site. In one version, the time limit is indicated by circuitry 27 which illuminates the playing piece most recently played and the site at which it is placed for a period of time equal to the chosen time limit.

Figure 1:
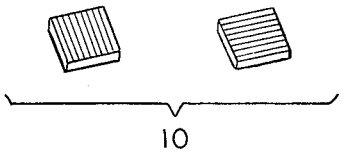
FIG. 1 is a perspective view of typical playing pieces.

Referring to FIG. 1, the numeral 10 indicates generally playing pieces suitable for use with the present invention. In the illustrated embodiment, the pieces are designed as tiles which may be varied in color, each player thus using a separate, distinct color.

Figure 2:
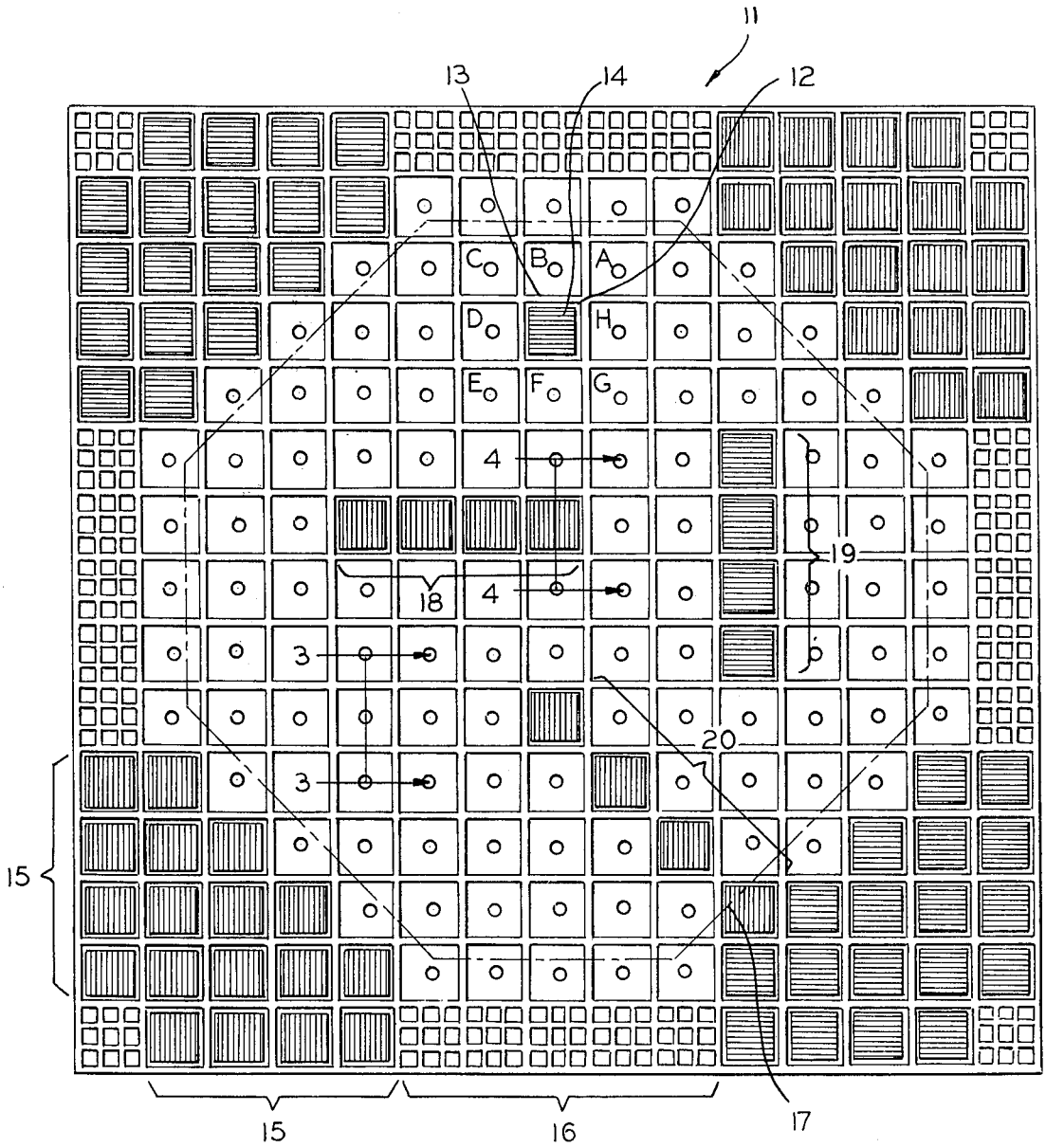
FIG. 2 is a top plan view of a preferred playing surface.

A preferred embodiment of the playing surface is illustrated generally at 11 in FIG. 2. A typical playing site 12 is framed by ridges 13 arranged to surround and positively index playing piece 14. During play, unplayed game pieces are stored at each corner of the board at storage sites 15, while blank squares 16 are provided at selected portions of the periphery of board 11. Storage sites 15 and blank squares 16 thereby define an octagonal playing surface indicated by the dashed lines at 17.

The game, as played between two players, proceeds as follows: Each player has a supply of tiles 10, said supplies being of different colors. Player 1 begins play by placing a tile anywhere on board 11 within playing surface 17. Player 2 then has a specified length of time, as, for example, 20 seconds, to play one of his game pieces on any square contiguous to the piece most previously played by player 1. As herein illustrated, if player 1 chooses site 12 for his first move, player 2, within the time limit specified, at his option, may place one of his game pieces on any of the unoccupied squares lettered A through H. After player 2 has selected one of said squares, player 1 may then play another game piece similarly contiguous to the most recently played piece of player 2. Play continues in this fashion until one of the players has managed to align four of his playing pieces either in a horizontal (illustrated at 18), vertical (illustrated at 19), or diagonal (illustrated at 20) configuration. Once a player has achieved this configuration, he has won and the game has ended. The game, thus, is an exercise in linear logic within precisely geometrically defined playing boundaries.

While the playing board as illustrated in FIG. 2 illustrates a playing area comprising 127 playing sites, it is to be anticipated that such boards may include as many or as few of such sites as desired to provide a more or less difficult course of play. While the foregoing descriptive embodiment contemplates a contest between two players, as many as eight players may participate at any one time. By altering the number of aligned playing pieces necessary to win the game as, for example, requiring that with three players only three such pieces need be aligned, and with four or more players that only any two such pieces may be aligned, the logic and strategies involved become even more complex and challenging.

Figure 3:
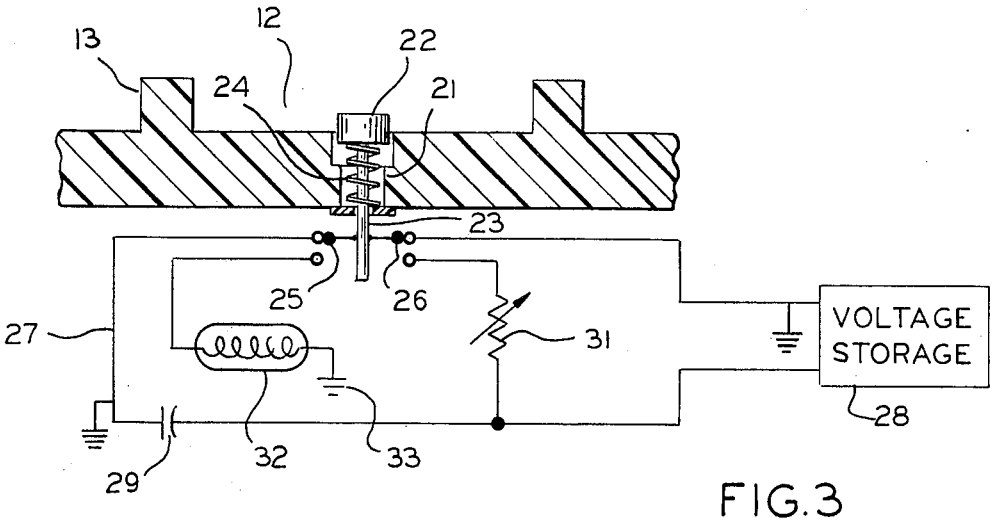
FIG. 3 is a partial section along 3—3 of FIG. 2, showing a proposed illumination circuit prior to illumination.
Figure 4:
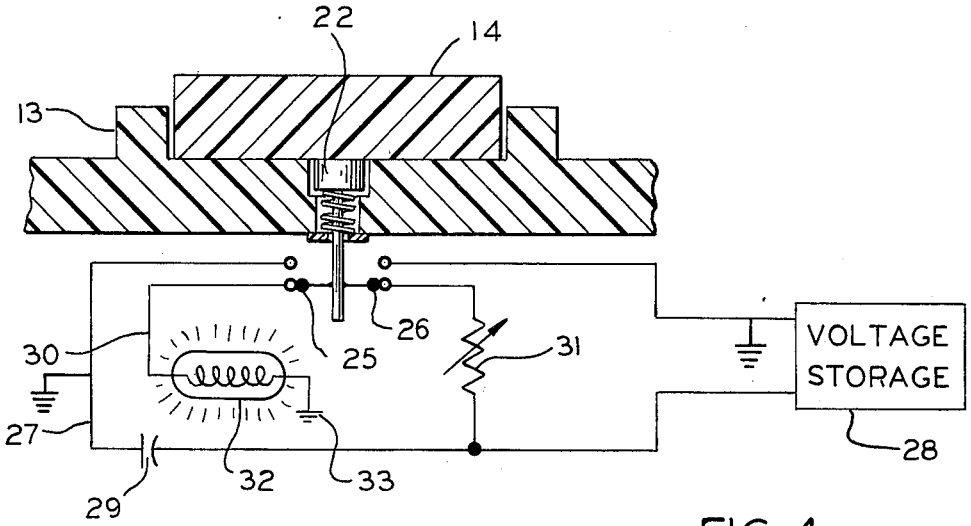
FIG. 4 illustrates the arrangement of FIG. 3 in an illuminated condition.

Contributing significantly to the difficulty and uniqueness of play is the additional constraint that players must move within a given time limit measured from the placing of the most previously played piece. To this end, the circuits, as illustrated in FIGS. 3 and 4, are provided as a positive, visually striking, and automatic means for measuring and indicating such time limit. Each playing site 12 may be provided with a micro switch 21 comprising a head 22, shaft 23 and spring bias means 24. Contacts 25 and 26 are mounted to shaft 23. Spring bias means 24 holds head 22 in position such that head 22 extends above the playing surface of site 12. In this position, contacts 25 and 26 complete charging circuit 27, consisting of voltage source 28 and capacitor 29.

As illustrated in FIG. 2, when playing piece 14 is inserted at site 12, micro switch 21 is depressed to open charging circuit 27 and brings contacts 25 and 26 into position to complete discharge circuit 30. Discharge circuit 30 comprises capacitor 29, variable resistor 31, and lamp 32, connected to ground at 33. Thus, when discharging circuit 30 is completed, capacitor 29 discharges through variable resistor 31 to illuminate lamp 32. By selecting appropriate values for capacitor 29 and variable resistor 31, the length of time during which lamp 32 remains illuminated may be accurately and conveniently varied.

Consistent with this embodiment, board 11 and playing piece 14 may be formed of translucent material such as a translucent or light-conducting plastic whereby the illumination furnished by lamp 32 will be transmitted therethrough and will be visible to the players. Thus, after a player has placed playing piece 14 at site 12 and said piece has become illuminated by activation of the illuminating circuit 30, the following player must play while said site and said playing piece are illuminated, and before said illumination is extinguished. If he fails to do so, he may be penalized and his opponent allowed to place another playing piece on the board.

In this fashion, the placement of a playing piece automatically marks the beginning and duration of the time limit during which the subsequent player must play. Although shown here as a rather rudimentary circuit, it is anticipated that a more economical and sophisticated circuit arrangement may be provided to increase the efficiency of the device as shown. Similarly, any pressure or contact activated switching means may be substituted for micro switch 21. By providing variable resistor 31, it is possible to selectively alter the length of time for which lamp 32 will remain illuminated, making it possible to lengthen or shorten the time limit to correspond to the level of skill or competitiveness of the players. Another feasible method of accurately setting and enforcing the time limit within which each player is to move would be to utilize the switching action of microswitch 21 to activate an externally situated electronic timer, thus providing a visible indicaton of how much time is remaining in the move period. Sonic signals such as the sounding of a tone or buzzer may also be employed.

Figure 5:
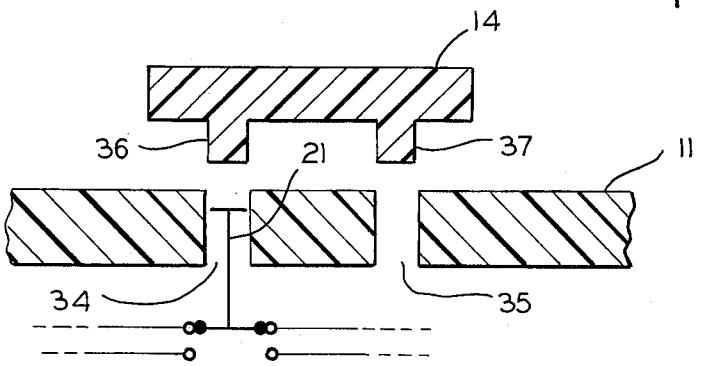
FIG. 5 illustrates a partial section of an alternate indexing arrangement.

An alternate means of positively indexing playing piece 14 is illustrated at FIG. 5. Each site on board 11 may be provided with a pair of apertures 34 and 35 corresponding to pins 36 and 37 formed on the underside of piece 14. Insertion of said pins into said apertures positively indexes piece 14 and micro switch 21 may be adapted to contact one of said pins.

While the foregoing has presented a particular embodiment of the invention, it is to be understood that the foregoing description is not intended to limit the invention. It is to be anticipated that those skilled in the art will conceive other embodiments which do not depart from the spirit and scope of the invention as herein disclosed.

I claim:

1. Apparatus for a game of logic and strategy, said apparatus comprising:

board means characterized by a plurality of regularly-arrayed playing piece site means;

a plurality of playing piece means adapted to selectively occupy said playing piece site means; and elapsed time indicator means, said indicator means activated by placement of one of said playing piece means at a selected one of said playing piece site means, said indicator means thereby signalling occupation of said selected site means, said signalling persisting for a predetermined length of time before ceasing.

2. The apparatus as recited in claim 1, wherein:

said indicator means includes a resistive capacitive circuit, said resistive capacitive circuit being characterized by a resistor of selectively variable resistance, whereby the length of said time period may be selectively altered.

3. The apparatus as recited in claim 1, wherein:

said indicator means is adapted to illuminate the most recently occupied of said playing piece site means, the time during which said illumination persists being selectively variable.

4. The apparatus as recited in claim 3, wherein:

said playing piece site means and said playing piece means are adapted to conduct light, thereby exhibiting a glow when illuminated.

5. Apparatus for playing a game of logic and strategy, said apparatus comprising:

a light-conducting playing surface characterized by a plurality of playing sites;

a plurality of light-conducting playing pieces adapted to selectively occupy said playing sites;

electrical illumination means, said illumination means positioned beneath said playing surface at each of said playing sites;

capacitive-resistive circuit means associated with said illumination means; and switch means, adapted to activate said capacitive-resistive circuit means, one said switch means positioned at each said playing site whereby placing a playing piece at a selected playing site activates said capacitive-resistive circuit means to activate said illumination means to illuminate said playing piece and said playing site for a predetermined length of time.

* * * * *